United States Patent [19]

Budzich

[11] 4,231,396

[45] * Nov. 4, 1980

[54] LOAD RESPONSIVE FLUID CONTROL VALVES

[76] Inventor: Tadeusz Budzich, 80 Murwood Dr., Moreland Hills, Ohio 44022

[ * ] Notice: The portion of the term of this patent subsequent to Nov. 15, 1994, has been disclaimed.

[21] Appl. No.: 7,159

[22] Filed: Jan. 26, 1979

Related U.S. Application Data

[63] Continuation of Ser. No. 828,643, Aug. 29, 1977, Pat. No. 4,165,761, which is a continuation of Ser. No. 709,202, Jul. 27, 1976, Pat. No. 4,058,139.

[51] Int. Cl.[3] ..... F15B 13/08

[52] U.S. Cl. ..... 137/596.13; 91/421; 91/436; 91/446

[58] Field of Search ..... 137/596.13; 91/421, 91/436, 446

[56] References Cited

U.S. PATENT DOCUMENTS

| | | | |
|---|---|---|---|
| 3,807,447 | 4/1974 | Masuda | 91/446 X |
| 3,984,979 | 10/1976 | Budzich | 91/446 X |
| 4,058,139 | 11/1977 | Budzich | 137/596.13 |

*Primary Examiner*—Gerald A. Michalsky

[57] ABSTRACT

A load responsive direction and flow control valve for use in fluid power load responsive system. The system is powered by a single fixed or variable displacement pump. The valve maintains a selected constant flow level during control of positive loads and automatically blocks pump flow to the actuator in presence of a negative load, providing the actuator inlet flow requirement from the valve exhaust manifold. The direction and flow control valve is equipped with a load responsive control which during control of positive load maintains a constant low pressure level at the actuator outlet and retains its control characteristics in a system in which multiple positive loads are simultaneously controlled.

5 Claims, 1 Drawing Figure

LOAD RESPONSIVE FLUID CONTROL VALVES

This is a continuation of application Ser. No. 828,643 filed Aug. 29, 1977, now U.S. Pat. No. 4,165,761 which is a continuation of Ser. No. 709,202, filed July 27, 1976, now U.S. Pat. No. 4,058,139.

BACKGROUND OF THE INVENTION

This invention relates generally to load responsive fluid control valves and to fluid power systems incorporating such valves, which systems are supplied by a single fixed or variable displacement pump. Such control valves can be used in a multiple load system, in which a plurality of loads is individually controlled under positive and negative load conditions by separate control valves.

In more particular aspects this invention relates to direction and flow control valves capable of controlling simultaneously a number of loads under both positive and negative load conditions.

In still more particular aspects this invention relates to direction and flow control valves capable of controlling simultaneously multiple positive and negative loads, which while controlling a negative load interrupt pump flow to the motor providing the motor inlet with fluid from the pressurized system exhaust.

Closed center load responsive fluid control valves are very desirable for a number of reasons. They permit load control with reduced power losses and therefore, increased system efficiency and when controlling one load at a time provide a feature of flow control irrespective of the variation in the magnitude of the load. Normally such valves include a load responsive control, which automatically maintains pump discharge pressure at a level higher, by a constant pressure differential, than the pressure required to sustain the load. A variable orifice, introduced between pump and load, varies the flow supplied to the load, each orifice area corresponding to a different flow level, which is maintained constant irrespective of variation in magnitude of the load. The application of such a system is, however, limited by several basic system disadvantages.

Since in this system the variable control orifice is located between the pump and the load, the control signal to a pressure regulating throttling device is at a high pressure level, introducing high forces in the control mechanism. Another disadvantage of such a control is that it regulates the flow of fluid into the motor or actuator and therefore does not compensate for fluid compressibility and leakage across both motor and valve. Fluid control valve for such a system is shown in U.S. Pat. No. 3,488,953 issued to Hausler.

The valve control can maintain a constant pressure differential and therefore constant flow characteristics when operating only one load at a time. With two or more loads, simultaneously controlled, only the highest of the loads will retain the flow control characteristics, the speed of actuation of the lower loads varying with the change in magnitude of the highest load. This drawback can be overcome in part by the provision of a proportional valve as disclosed in my U.S. Pat. No. 3,470,694, dated Oct. 7, 1969 and also in U.S. Pat. No. 3,455,210 issued to Allen on July 15, 1969. However, while these valves are effective in controlling multiple positive loads they utilize a controlling orifice located between the pump and the motor during positive load mode of operation and therefore control the fluid flow into the fluid motor instead of controlling fluid flow out of the fluid motor. These valves also while effective when controlling positive loads, when operating negative loads connect system pump with actuator inlet, unnecessarily using the pump flow and subjecting actuator to increased loads.

This drawback can be overcome in part by provision of fluid control valves as disclosed in U.S. Pat. No. 3,807,447 issued to Masuda on Apr. 30, 1974. However, while these valves utilize actuator exhaust fluid for actuator inlet flow requirement when controlling negative loads they regulate actuator inlet pressure by bypassing fluid to a down stream load circuit. Masuda's valves and their proportional control system are based on series type circuit in which excess fluid flow is successively diverted from one valve to the other and in which loads arranged in series determine the system pressure. In such a system flow to the last valve operating a load must be delivered through all of the bypass sections of all of the other system valves, resulting in higher fluid throttling loss. These valves are not adaptable to simultaneous control of multiple loads in parallel circuit operation since they do not provide system load control pressure signal to the pump flow control mechanism. Also controls of these valves respond to the pressure differential due to flow across a variable orifice therefore varying the area of flow between the actuator inlet and actuator outlet with variation in the system pressure during control of negative load.

SUMMARY OF THE INVENTION

It is therefore a principal object of this invention to provide an improved load responsive direction and flow control valve which would retain its flow control characterisitics when controlling a positive load by maintaining a constant low pressure level at the outlet of the motor or actuator.

Another object of this invention is to provide an improved load responsive direction and flow control valve which when controlling positive load will retain its proportional flow characteristics in a system in which multiple positive loads are simultaneously controlled.

Still another object of this invention is to provide an improved load responsive direction and flow control valve which will automatically block system pump from motor or actuator inlet while connecting it with valve exhaust manifold during control of negative load.

Still another object of this invention is to provide an improved load responsive direction and flow control valve equipped with a pressurized exhaust manifold, flow from which supplies the inlet flow requirements of a motor or actuator controlling a negative load.

Briefly the foregoing and other additional objects and advantages of this invention are accomplished by providing a novel load responsive direction and flow control valve which will provide a proportional flow control of positive load in a system in which multiple positive loads are simultaneously controlled and which in presence of a negative load will automatically disconnect the pump from the actuator inlet connecting it with pressurized valve exhaust manifold.

Additional objects of this invention will become apparent when referring to the preferred embodiment of the invention as shown in the accompanying drawing and described in the following detailed description.

DESCRIPTION OF THE PREFERRED EMBODIMENT

Figure 1:
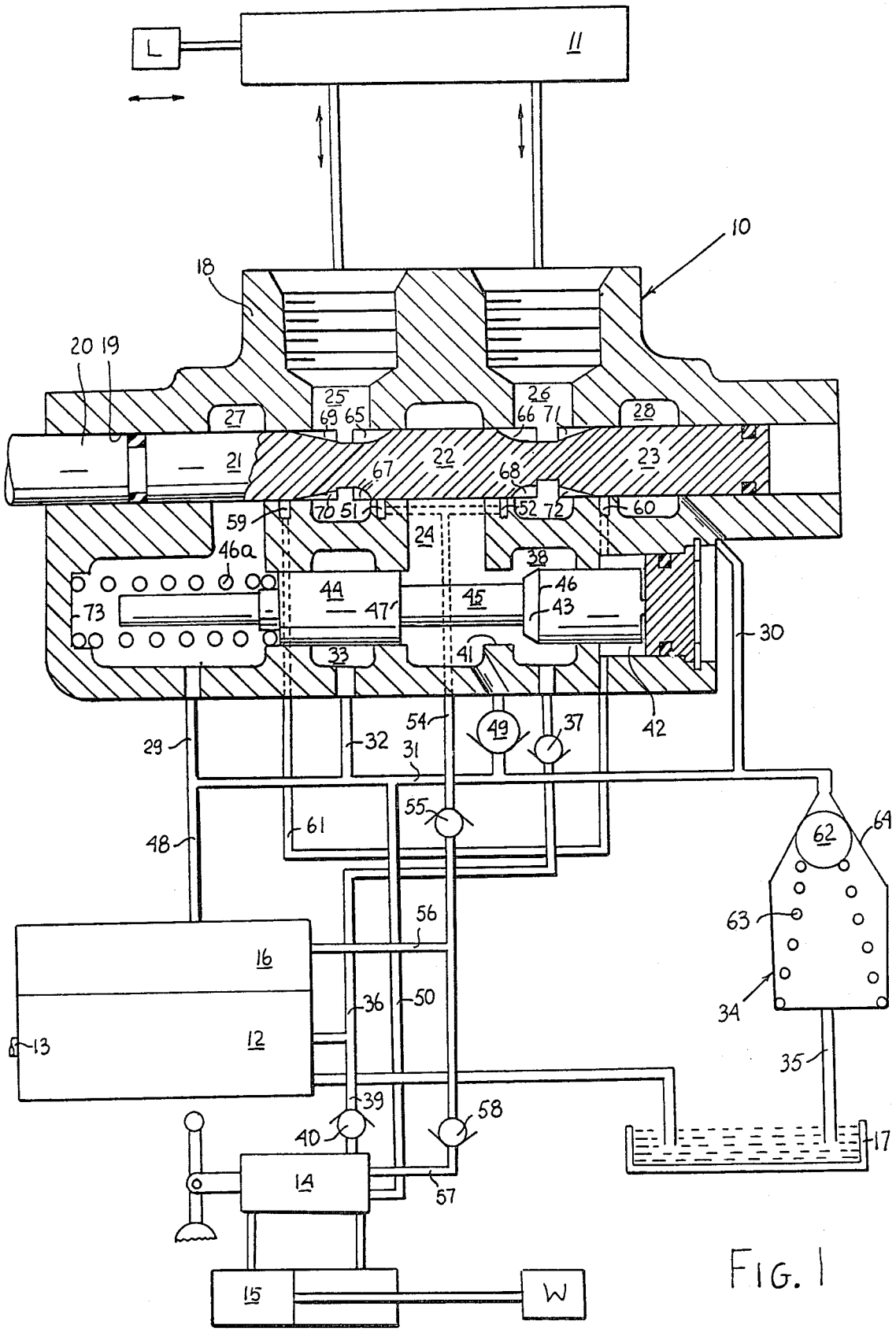
FIG. 1 is a longitudinal sectional view of an embodiment of a control valve having a throttling and blocking spool responsive to pressure in the actuator outlet for use in load responsive fluid control system, with lines, system pump, pump control, second load responsive valve, exhaust relief valve and system reservoir shown diagramatically.

Referring now to the drawing FIG. 1 an embodiment of a flow control valve, generally designated as 10, is shown interposed between a diagramatically shown fluid motor 11 driving load L and a pump 12 of a fixed displacement type driven through a shaft 13 by a prime mover not shown. Similarly, a flow control valve 14, identical to the flow control valve 10, is interposed between a diagramatically shown fluid motor 15 driving a load W and the pump 12. Fluid flow from the pump 12 to flow control valves 10 and 14 is regulated by a differential pressure relief valve 16 which can be mounted as shown on the pump 12, or be an integral part of the flow control valve 10. If the differential pressure relief valve 16 is made part of the valve assembly it is connected to the fixed displacement pump 12 by a high pressure line capable of transmitting full flow of the pump. The differential pressure relief valve 16, in a well known manner, by bypassing fluid from the pump 12 to a reservoir 17, maintains discharge pressure of the pump 12 at a level, higher by a constant pressure differential, than load pressure developed in fluid motor 11 or 15.

The flow control valve 10 although it can be of a threeway type is shown as a fourway type and has a housing 18 provided with bore 19, axially guiding a valve spool 20. The valve spool 20 is equipped with lands 21, 22 and 23 which in neutral position of the valve spool 20, as shown in FIG. 1, isolate a fluid supply chamber 24, load chambers 25 and 26 and outlet chambers 27 and 28. The outlet chambers 27 and 28 are connected through lines 29, 30, 31 and 32 to an exhaust chamber 33 and through an exhaust relief valve, generally designated as 34 and line 35 to the reservoir 17.

The pump 12 through its discharge line 36 and a check valve 37 is connected to a fluid inlet chamber 38. Similarly the pump 12 is connected through discharge line 39 and a check valve 40 to fluid inlet chamber of flow control valve 14. Control bore 41 connects the fluid inlet chamber 38 with the fluid supply chamber 24, the fluid exhaust chamber 33, the fluid outlet chamber 27 and fluid control space 42. A control spool 44, axially slidable in control bore 41, projects into control space 42 and fluid outlet chamber 27 and is provided with stem 45 terminating in throttling surface 43 and cut off plane 46 and control plane 47. Throttling surface 43 may be of a conical type as shown in FIG. 1 or in a well known manner can be substituted by suitable throttling grooves. The control spool 44, as shown in FIG. 1, isolates the exhaust chamber 33 from the supply chamber 24 and with cut off plane 46 and throttling surface 43 permits communication between the fluid inlet chamber 38 and the fluid supply chamber 24. The control spool 44 is biased by spring 46*a* towards position to provide free passage between the inlet chamber 38 and the supply chamber 24.

Excess pump flow from the differential pressure relief valve 16 is delivered through line 48 to exhaust line 31, which communicates with the exhaust chamber 33, a bypass check valve 49, lines 29 and 30 which connect to the outlet chambers 27 and 28, the exhaust relief valve 34 and through line 50 with all of exhaust passages of the flow control valve 14. The bypass check valve 49 is interposed between exhaust line 31 and the fluid supply chamber 24.

Positive load sensing ports 51 and 52, located between load chambers 25 and 26 and the supply chamber 24 and blocked in neutral position of valve spool 20 by land 22, are connected through signal passage 54, a check valve 55 and signal line 56 to the differential pressure relief valve 16. In a similar manner positive load sensing ports of flow control valve 14 are connected through line 57, a check valve 58 and signal line 56 to the differential pressure relief valve 16. Negative load sensing ports 59 and 60 located between the load chambers 25 and 26 and the outlet chambers 27 and 28 and blocked in neutral position of valve spool 20 by lands 21 and 23 are connected through signal passage 61 with control space 42.

The exhaust relief valve, generally designated as 34, interposed between combined exhaust circuits of flow control valves 10 and 14 including bypassing circuit of pump 12 and reservoir 17, is provided with a throttling member 62, biased by a spring 63 towards engagement with seat 64.

Land 22 is provided with first flow slots 65 located between the load chamber 25 and the supply chamber 24 and second flow slots 66 located between the load chamber 26 and the supply chamber 24. Land 22 is also provided with shorter communication slots 67 and 68 located in the plane of load sensing ports 51 and 52. Land 21 is provided with first exhaust metering slots 69 and first communication slot 70 located between the load chamber 25 and the outlet chamber 27. Land 23 is provided with second exhaust metering slots 71 and a second communication slot 72 located between the load chamber 26 and the outlet chamber 28.

The sequencing of the control spool 44 is such that when moved from right to left, when cut off plane 46 closes communication between the inlet chamber 38 and the supply chamber 24, control plane 47 is positioned at the point of opening communication between the supply chamber 24 and the exhaust chamber 33. Further movement of the control spool 44 from right to left will establish full flow communication between the exhaust chamber 33 and the supply chamber 24.

As previously described with flow control valves 10 and 14 controlling loads L and W the differential pressure relief valve 16, in a well known manner, will regulate fluid flow delivered from the fixed displacement pump 12 to discharge line 36, by bypassing the fluid flow to line 48 and exhaust line 31, to maintain the pressure in discharge line 36 higher, by a constant pressure differential, than the highest load pressure signal transmitted through the check valve system to the signal line 56. Therefore with valve spools of flow control valves 10 and 14 in their neutral position, blocking positive load sensing ports 51 and 52, signal pressure input to the differential pressure relief valve 16 from the signal line 56 will be at minimum pressure level.

With fixed displacement pump 12 started up the differential pressure relief valve 16 will bypass through line 48, exhaust line 31, the exhaust relief valve 34 and line 35 all of pump flow to the system reservoir 17 at minimum pressure level, equivalent to preload in the spring 63, while automatically maintaining pressure in discharge line 36 at a constant pressure, higher by a constant pressure differential, than pressure in signal line 56, which is equal to minimum pressure in exhaust line 31. Therefore all of pump flow is diverted by the differential pressure relief valve 16 to the low pressure exhaust circuit, as previously described, without entering flow passages of flow control valves 10 and 14.

Assume that while constant standby pressure condition is maintained in discharge line 36 the valve spool is initially displaced from left to right to connect the load chamber 25 through communication slot 67 with the positive load sensing port 51 and to connect load chamber 26 through communication slot 72 with the negative load sensing port 60, while lands 21, 22 and 23 still block communication between the supply chamber 24, load chambers 25 and 26 and outlet chambers 27 and 28. Assume also that actuator 11 is subjected to a positive load. Load pressure transmitted from actuator 11, the load chamber 25, the positive load sensing port 51 and signal passage 54, in a well known manner, will open the check valve 55, close the check valve 58 and reacting through signal line 56 on the differential pressure relief valve 16 increase pressure in discharge line 36 to maintain a constant pressure differential between the pump pressure in discharge line 36 and load pressure in signal line 56. This pump discharge pressure will be transmitted through discharge line 36 to the fluid inlet chamber 38 and past cut off plane 46 to the fluid supply chamber 24. Since control space 42 is connected to the negative load sensing port 60 which is subjected to minimum pressure the control spool 44 will be maintained by the spring **46*a* in position as shown in FIG. 1**.

Assume that from the position in which load chamber 25 is connected to the positive load sensing port 51 the valve spool 20 is further displaced to the right, connecting the load chamber 25 with the supply chamber 24 while the load chamber 26 is still isolated from the outlet chamber 28 by land 23. The pressure in the load chamber 25 will begin to rise, this change being transmitted through the positive load sensing port 51, in a manner as previously described, to the differential pressure relief valve 16, proportionally increasing the pressure in discharge line 36. This increase in positive load pressure in the load chamber 25 will overcome resistance of load L and start gradually increasing pressure in load chamber 26. Since the load chamber 26 is connected through second communication slot 72 and negative sensing port 60 to fluid control space 42, the rising pressure in the control space 42, reacting on the cross-sectional area of control spool 44 will overcome the preload of the control spring **46*a* and move the control spool 44 from right to left, closing by cut off plane 46 communication between the inlet chamber 38 and the supply chamber 24. The system will find itself then in a condition of equilibrium, with spool 44 assuming a modulating position in which it will maintain the pressure in the load chamber 26 at a relatively constant level, as determined by the preload in the spring 46*a***.

Further movement of the valve spool 20 from left to right will establish communication by second exhaust metering slot 71 between load chamber 26 and the outlet chamber 28. Since outlet chamber 28 is maintained at low exhaust pressure level by the exhaust relief valve 34, fluid will flow from the load chamber 26 to the outlet chamber 28 resulting in a momentary drop in pressure in the load chamber 26. This decrease in pressure will result in change in the modulating position of control spool 44, which will automatically assume a new throttling position, to maintain the load chamber 26 at a constant pressure level. Since both the load chamber 26 and outlet chamber 28 are maintained at constant pressure levels, a constant pressure differential is maintained between these chambers and the flow between these chambers will be proportional to opening of second exhaust metering slots 71, which in turn is proportional to the displacement of the valve spool 20. Therefore each position of the valve spool 20 will correspond to a certain specific constant flow level from actuator 11, irrespective of the magnitude of the load L. While control action of the control spool 44 is taking place the discharge pressure of the fixed displacement pump 12 in the discharge line 36 is automatically maintained by the differential pressure relief valve 16 at a pressure, higher by a constant pressure differential than the pressure in the supply chamber 24 and the load chamber 25.

Assume that valve spools of flow control valves 10 and 14 were simultaneously actuated to a position, at which fluid flow is delivered to actuators 11 and 15. Assume also that loads L and W are positive and that the load W is higher than load L. Flow control valve 14, in a manner as previously described, will provide proportional control of load W, fixed displacement pump 12 providing discharge pressure higher by a constant pressure differential than the pressure in the supply chamber of the flow control valve 14. Flow control valve 10 will then be supplied with a pressure much higher than that necessary to actuate load L. Since, as previously described, the control spool 44 will assume a modulating position, to maintain the load chamber 26 at a constant pressure level, excessive pressure will be throttled at the throttling surface 43, the flow through the control valve 10 being proportional to the displacement of the valve spool 20 and independent of the discharge pressure of the fixed displacement pump 12.

Assume that while constant minimum standby pressure condition is maintained in discharge line 36, the valve spool 20 is initially displaced from right to left connecting the load chamber 26 with positive load sensing port 52 through communication slot 68 and also connecting the load chamber 25 with the negative load sensing port 59. Assume also that the fluid motor 11 is subjected to a negative load, pressurizing the load chamber 25 and maintaining the load chamber 26 at minimum pressure. Therefore pressure signal, transmitted through the positive load sensing port 52, will not change the setting of differential pressure relief valve 16, the pump 12 maintaining discharge line 36 at minimum pressure level. The negative load pressure from the load chamber 25 will be transmitted through signal passage 61 to control space 42 where, reacting on the cross-sectional area of the control spool 44, it will move the control spool 44 against the biasing force of spring **46*a* all the way from right to left, first closing off with cut off plane 46 communication between inlet chamber 38 and the supply chamber 24. Control plane 47 of the control spool 44 is so positioned that while cut off plane 46 is cutting off communication between the inlet chamber 38 and the supply chamber 24, control plane 47 is establishing communication between the supply chamber 24 and the exhaust chamber 33. Further movement to the left of control spool 44 will open wide communication between the supply chamber 24** and the exhaust chamber 33. Total movement of control spool 44 to the left is limited by face 73 of the housing 18.

Further movement of the valve spool 20 to the left will first open communication between the supply chamber 24 and the load chamber 26 and then open communication through first exhaust metering slot 69 between the load chamber 25 and the outlet chamber 27, throttling fluid flow from actuator 11 to the valve exhaust circuit, maintained at a constant pressure level by exhaust relief valve 34. High pressure flow out of actuator 11, during control of negative load, will be replenished on the other side of actuator from the exhaust chamber 33 through opening created by displacement of the control plane 47 in respect to the exhaust chamber 33, connecting exhaust chamber 33 and the supply chamber 24 and from exhaust line 31 through the bypass check valve 49, at a pressure level of exhaust relief valve 34, while utilizing a combined exhaust flow from the outlet chamber 27 and the differential pressure relief valve 16. The exhaust fluid at increased pressure is supplied to the actuator inlet during control of negative load, while the fixed displacement pump 12 is completely isolated by cut off plane 46 from the supply chamber 24 and the actuator 11. Therefore, since none of the potential pump delivery is used as actuator make-up fluid, during control of negative load, higher pump capacity is made available for simultaneous control of multiple positive loads. During control of two negative loads, for example loads L and W, the exhaust circuit is also supplied by line 50 with exhaust fluid from the flow control valve 14, the combined exhaust flow of both control valves and the bypass flow from the differential pressure relief valve 16 being available for the make-up flow to the system actuators controlling negative loads, while full pump capacity is being saved for operation of the other positive loads.

When valve spool 20 is moved rapidly from left to right connecting the fluid supply chamber 24 with the load chamber 25, unless the differential pressure relief valve 16 responds fast enough to raise the discharge pressure in the discharge line 36 and the supply chamber 24 to the level, equal to or higher than the load pressure existing in the load chamber 25, a back flow from load chamber 25 to the fixed displacement pump 12 can take place, resulting in momentary drop in load L. To prevent this back flow, check valves 37 and 40 are provided in the pump discharge line. Check vavles 37 and 40, while preventing back flow, permit the differential pressure relief valve 16 to raise the pump pressure to a level at which the check valves 37 and 40 will open permitting free flow between the pump and the actuator.

So far the system shown in FIG. 1 has been described as using fixed displacement pump 12, flow of which is controlled by the differential pressure relief valve 16. Pump 12 can also be of variable displacement type and can be controlled by a differential pressure compensator which, in a well known manner, varies the displacement of the pump to maintain discharge line 36 at a pressure higher by a constant pressure differential than the load signal pressure transmitted to differential pressure compensator from the load sensing circuit by signal line 56. Therefore in an identical way a fixed displacement pump controlled by a differential pressure relief valve and a variable displacement pump controlled by a differential pressure compensator will maintain a constant pressure differential between discharge line 36 and signal line 56, in response to the highest system load being operated. Although the load control features of systems using fixed and variable displacement pumps are identical, the amount of flow delivered to exhaust circuit and specifically to exhaust line 31 is different for each pump. When using fixed displacement pump all of the excess pump flow is delivered by the differential relief valve through line 48 to exhaust line 31. With system valve spools in neutral position all of the pump flow is directed by the differential relief valve to exhaust line 31. When using a variable displacement pump the pump supplies the exact amount of fluid, to satisfy the system demand, none of the pump flow normally being diverted to exhaust line 31. Therefore when using a variable displacement pump less exhaust flow is available to satisfy inlet flow requirements of system actuators during control of negative load. Normally an actuator, in the form of a cylinder, due to the presence of piston rod, displaces different flows from each cylinder port per unit length displacement of its piston. Therefore with use of variable displacement pump, while controlling negative load, the exhaust flow out of the cylinder must be greater than its inlet flow requirement and therefore piston end of the cylinder must be subjected to negative load.

Although the preferred embodiments of this invention have been shown and described in detail it is recognized that the invention is not limited to the precise form and structure shown and various modifications and rearrangements as will occur to those skilled in the art upon full comprehension of this invention may be resorted to without departing from the scope of the invention as defined in the claims.

What is claimed is:

1. A valve assembly supplied with pressure fluid by a pump comprising a housing having a fluid inlet chamber connected to said pump, a fluid supply chamber, first and second load chambers, and fluid exhaust means, first valve means for selectively interconnecting said fluid load chambers with said fluid supply chamber and said fluid exhaust means, first variable fluid metering orifice means responsive to movement of said first valve means between said fluid supply chamber and said load chambers, second variable fluid metering orifice means responsive to movement of said first valve means between said load chambers and said exhaust means, negative load pressure sensing means between said load chambers and said exhaust means selectively communicable with said load chambers by said first valve means, second valve means having fluid isolating means between said inlet chamber and said supply chamber, said inlet chamber being solely communicable with said supply chamber by said second valve means, said fluid isolating means having means operable to isolate said inlet chamber from said supply chamber when pressure in said negative load pressure sensing means exceeds a certain predetermined level, and fluid replenishing means operable to supply fluid flow to said load chamber isolated by said fluid isolating means.

2. A valve assembly as set forth in claim 1 wherein said housing has positive load pressure sensing means selectively communicable with said load chambers by said first valve means, said positive load pressure sensing means having means operable to transmit control pressure signal to said pump.

3. A valve assembly as set forth in claim 1 wherein said second valve means has force generating means responsive to pressure in said negative load pressure sensing means operable to move said fluid isolating means towards position to close communication between said inlet chamber and said supply chamber.

4. A valve assembly as set forth in claim 1 wherein said second valve means is interposed between said negative load pressure sensing means and said fluid exhaust means and spring biasing means to bias said fluid isolating means of said first valve means towards position to open communication between said inlet chamber and said supply chamber.

5. A valve assembly as set forth in claim 1 wherein said fluid replenishing means has check valve means between said fluid exhaust means and said supply chamber.

* * * * *